US010504412B2

(12) United States Patent
Han et al.

(10) Patent No.: US 10,504,412 B2
(45) Date of Patent: Dec. 10, 2019

(54) DISPLAY APPARATUS AND DRIVING METHOD THEREOF

(71) Applicant: Samsung Display Co., Ltd., Yongin-si, Gyeonggi-do (KR)

(72) Inventors: Sangsu Han, Hanam-si (KR); Myeongsu Kim, Hwaseong-si (KR); Silyi Bang, Yongin-si (KR); Kuk-hwan Ahn, Hwaseong-si (KR); Kwan-young Oh, Hanam-si (KR); Jaeho Choi, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 15/725,077

(22) Filed: Oct. 4, 2017

(65) Prior Publication Data

US 2018/0114479 A1 Apr. 26, 2018

(30) Foreign Application Priority Data

Oct. 25, 2016 (KR) ..... 10-2016-0139410

(51) Int. Cl.
*G09G 3/20* (2006.01)
*G09G 3/36* (2006.01)

(52) U.S. Cl.
CPC ..... *G09G 3/2092* (2013.01); *G09G 3/20* (2013.01); *G09G 3/3688* (2013.01);
(Continued)

(58) Field of Classification Search
CPC ..... G09G 3/20; G09G 3/2092; G09G 3/3666; G09G 3/3688; G09G 3/3696;
(Continued)

(56) References Cited

U.S. PATENT DOCUMENTS 4,264,924 A * 4/1981 Freeman ..... G09B 7/073 348/484
4,264,925 A * 4/1981 Freeman ..... H04N 7/162 331/117 FE (Continued)

FOREIGN PATENT DOCUMENTS

KR 10-0919708 B1 10/2009
KR 10-2010-0007628 A 1/2010
KR 10-2015-0075640 A 7/2015

OTHER PUBLICATIONS

EPO Extended Search Report dated Feb. 27, 2018, for corresponding European Patent Application No. 17198089.9 (12 pages).

*Primary Examiner* — Michael J Eurice
(74) *Attorney, Agent, or Firm* — Lewis Roca Rothgerber Christie LLP

(57) ABSTRACT

A display device includes: a display panel configured to display an image; a timing controller configured to output line configuration signals, frame configuration signals, and image signals; a plurality of data drivers each of which is configured to receive the line configuration signals, the frame configuration signals, and the image signals and provide a data voltage corresponding to the image signals to the display panel according to the line configuration signals and the frame configuration signals; a high speed driving line configured to connect the timing controller and one of the data drivers and transfer the image signals; and a low speed driving line configured to connect the timing controller and the data drivers and transfer the line configuration signals.

20 Claims, 18 Drawing Sheets

(52) U.S. Cl.
CPC ... *G09G 3/3696* (2013.01); *G09G 2310/0278* (2013.01); *G09G 2310/08* (2013.01); *G09G 2330/028* (2013.01); *G09G 2360/12* (2013.01); *G09G 2370/045* (2013.01); *G09G 2370/08* (2013.01)

(58) Field of Classification Search
CPC ... G09G 2310/0213; G09G 2310/0278; G09G 2310/04; G09G 2310/08; G09G 2320/103; G09G 2330/021; G09G 2330/028; G09G 2340/0435; G09G 2360/12; G09G 2370/12; G09G 2370/045; G09G 2370/047; G09G 2370/08; G09G 5/001; H04N 5/63
See application file for complete search history.

(56) References Cited

U.S. PATENT DOCUMENTS 4,412,313 A * 10/1983 Ackland ..... G11C 7/1051 365/205
4,459,677 A * 7/1984 Porter ..... G06F 3/0489 345/520
4,475,161 A * 10/1984 Stock ..... G06F 3/153 345/604
4,564,915 A * 1/1986 Evans ..... G06F 3/153 345/550
4,605,950 A * 8/1986 Goldberg ..... H04N 7/081 348/389.1
4,617,596 A * 10/1986 Yoshida ..... H04N 1/3873 358/451
4,831,581 A * 5/1989 Rubinfeld ..... G06F 12/0835 711/126
4,851,991 A * 7/1989 Rubinfeld ..... G06F 9/461 711/5
5,091,845 A * 2/1992 Rubinfeld ..... G06F 9/3877 711/118
5,109,434 A * 4/1992 Shimizu ..... H04N 1/00111 358/443
5,144,445 A * 9/1992 Higashitsutsumi .. H04N 5/0733 348/294
5,237,567 A * 8/1993 Nay ..... G06F 13/374 370/438
5,321,811 A * 6/1994 Kato ..... G09G 3/3629 345/520
6,078,318 A * 6/2000 Mori ..... G09G 3/3629 345/204
9,053,673 B2 6/2015 Yuan et al.
2005/0249356 A1* 11/2005 Holmi ..... B60R 11/0217 381/86
2006/0259938 A1* 11/2006 Kinoshita ..... H04N 21/4622 725/118
2006/0285847 A1* 12/2006 McCall ..... G06F 13/4068 398/73
2007/0242008 A1 10/2007 Cummings
2009/0172224 A1* 7/2009 Suh ..... H04L 1/007 710/106
2009/0231314 A1* 9/2009 Hanaoka ..... G09G 3/2096 345/208
2009/0278984 A1* 11/2009 Suzuki ..... G09G 5/003 348/554
2012/0044952 A1* 2/2012 Ono ..... H04L 12/40065 370/463
2013/0038602 A1* 2/2013 Kim ..... H04N 13/332 345/419
2013/0208101 A1* 8/2013 Ono ..... A61B 1/00193 348/65
2013/0330088 A1* 12/2013 Oshima ..... H04B 10/11 398/130
2014/0056224 A1* 2/2014 Rubin ..... H04W 28/021 370/328
2014/0118235 A1 5/2014 Hong et al.
2014/0146033 A1* 5/2014 Koyama ..... G09G 3/3655 345/212
2014/0186026 A1* 7/2014 Oshima ..... H04B 10/116 398/25
2014/0225851 A1* 8/2014 Saitoh ..... G06F 3/041 345/173
2014/0288947 A1* 9/2014 Simpson ..... G06F 19/3418 705/2
2014/0320465 A1* 10/2014 Oh ..... G09G 3/3688 345/204
2014/0368484 A1* 12/2014 Tanaka ..... G09G 3/3648 345/208
2015/0154942 A1* 6/2015 Hsu ..... G09G 5/18 345/213
2015/0243232 A1* 8/2015 Kim ..... G09G 3/3648 345/214
2015/0243254 A1* 8/2015 Choi ..... G09G 5/18 345/212
2016/0134371 A1* 5/2016 Oshima ..... H04B 10/116 398/118
2016/0274859 A1* 9/2016 Terada ..... G10H 1/0008
2016/0277134 A1* 9/2016 Terada ..... H04H 60/04
2017/0295343 A1* 10/2017 Konishi ..... G09G 3/2096
2018/0205886 A1* 7/2018 Lee ..... H04N 5/23245
2018/0240430 A1* 8/2018 Um ..... G09G 3/3614

* cited by examiner

DISPLAY APPARATUS AND DRIVING METHOD THEREOF

CROSS-REFERENCE TO RELATED APPLICATION

This patent application claims priority to and the benefit of Korean Patent Application No. 10-2016-0139410, filed on Oct. 25, 2016, in the Korean Intellectual Property Office, the entire contents of which are hereby incorporated by reference.

BACKGROUND

Aspects of some example embodiments of the present invention relate to a display device and a method for driving the same.

A display device is provided with a source drive integrated circuit for supplying a data voltage to data lines, a gate drive integrated circuit for sequentially supplying gate pulses (or scan pulses) to gate lines of a display panel, and a timing controller for controlling drive integrated circuits.

Recently, the demand for tablets, smartphones, or monitors with high resolution and high frame rate has increased. Accordingly, research is being carried out to improve the transfer rate of drive integrated circuits, but it is difficult to improve the transfer rate due to physical limitations of integrated circuits and an interface.

The above information disclosed in this Background section is for enhancement of understanding of the background of the inventice concept, and therefore, it may contain information that does not constitute prior art.

SUMMARY

According to some example embodiments of the present invention, a throughput of a high speed driving line may be improved, because a timing controller transfers a line configuration signal via a low speed driving line.

Furthermore, according to some example embodiments of the present invention, because a bandwidth of the high speed driving line may be improved, a target amount of data may be transferred even if a transfer rate is decreased, and thus power consumption may be improved due to the improvement of the transfer rate.

According to some example embodiments of the present invention, a display device includes: a display panel configured to display an image; a timing controller configured to output line configuration signals, frame configuration signals, and image signals; a plurality of data drivers each of which is configured to receive the line configuration signals, the frame configuration signals, and the image signals and provide a data voltage corresponding to the image signals to the display panel according to the line configuration signals and the frame configuration signals; a high speed driving line configured to connect the timing controller and one of the data drivers and transfer the image signals; and a low speed driving line configured to connect the timing controller and the data drivers and transfer the line configuration signals.

According to some example embodiments, the timing controller is configured to output the image signals in a unit of line data, wherein an (n+1)-th line configuration signal among the line configuration signals is output during a period overlapping with a period in which n-th line data among the line data is output, or is output prior to the period in which the n-th line data is output where n is a natural number.

According to some example embodiments, the data driver is configured to transfer a link state signal to the timing controller via the low speed driving line between periods in which two of the line configuration signals are applied.

According to some example embodiments, the timing controller is configured to output the image signals in a unit of line data, wherein the line data is transferred in a unit of a line segment, wherein the line configuration signals are transferred in a unit of a line configuration segment, wherein one line configuration segment is transferred in synchronization with a plurality of the line segments.

According to some example embodiments, the timing controller is configured to transfer an image signal corresponding to one frame among the image signals during a vertical synchronization period, and then transfer the frame configuration signals via the high speed driving line during a vertical blank period.

According to some example embodiments, the timing controller is configured to transfer the frame configuration signals via the low speed driving line.

According to some example embodiments, the frame configuration signals comprise a first frame configuration signal and a second frame configuration signal, wherein the first frame configuration signal comprises a part of configuration information of the data driver required when outputting the image signal corresponding to one frame as a data voltage, and the second frame configuration signal comprises a remaining part of the configuration information, wherein the timing controller transfers the first frame configuration signal via the high speed driving line, and transfers the second frame configuration signal via the low speed driving line.

According to some example embodiments, the high speed driving line and the low speed driving line have different interfaces, wherein the high speed driving line has a higher transfer efficiency than that of the low speed driving line.

According to some example embodiments of the present invention, a display device includes: a display panel configured to display an image; a timing controller configured to generate coding line configuration signals having a high level or a low level by coding received line configuration signals, and output the coding line configuration signals, frame configuration signals, and image signals; data drivers each of which is configured to receive the coding line configuration signals, the frame configuration signals, and the image signals and provide a data voltage corresponding to the image signals to the display panel according to the coding line configuration signals and the frame configuration signals; a high speed driving line configured to connect the timing controller and one of the data drivers and transfer the image signals; and a low speed driving line configured to connect the timing controller and the data drivers and transfer the coding line configuration signals.

According to some example embodiments, the timing controller is configured to sense information about a link state with the data driver according to the line configuration signals.

According to some example embodiments, in a method for driving a display device, the method includes: transferring, by a timing controller, image signals to a data driver via a high speed driving line; transferring, by the timing controller, line configuration signals to the data driver via a low speed driving line; providing, by the data driver, a data voltage corresponding to the image signals to a display panel according to the line configuration signals; and displaying, by the display panel, an image corresponding to the data voltage.

According to some example embodiments, transferring the image signals to the data driver via the high speed driving line comprises transferring the image signals in a unit of line data, wherein transferring the line configuration signals to the data driver via the low speed driving line comprises outputting an (n+1)-th line configuration signal among the line configuration signals during a period overlapping with a period in which n-th line data among the line data is output where n is a natural number.

According to some example embodiments, the line data is transferred in a unit of a line segment, wherein the line configuration signals are transferred in a unit of a line configuration segment, wherein one line configuration segment is transferred in synchronization with a plurality of the line segments.

According to some example embodiments, the method further includes providing, by the data driver, a link state signal to the timing controller via the low speed driving line.

According to some example embodiments, the method further includes: transferring, by the timing controller, frame configuration signals via the high speed driving line; and providing, by the data driver, the data voltage corresponding to the image signals to the display panel according to the frame configuration signals additionally.

According to some example embodiments, the method further includes: transferring, by the timing controller, frame configuration signals via the low speed driving line; and providing, by the data driver, the data voltage corresponding to the image signals to the display panel according to the frame configuration signals additionally.

According to some example embodiments, the method further includes: transferring, by the timing controller, a part of frame configuration signals via the high speed driving line; transferring, by the timing controller, a remaining part of the frame configuration signals via the low speed driving line; and providing, by the data driver, the data voltage corresponding to the image signals to the display panel according to the frame configuration signals additionally.

According to some example embodiments, in a method for driving a display device, the method includes: transferring, by a timing controller, image signals and a part of line configuration signals to a data driver via a high speed driving line; transferring, by the timing controller, a remaining part of the line configuration signals to the data driver via a low speed driving line; providing, by the data driver, a data voltage corresponding to the image signals to a display panel according to the line configuration signals; and displaying, by the display panel, an image corresponding to the data voltage.

According to some example embodiments, the method further includes providing, by the data driver, a link state signal to the timing controller via the low speed driving line.

According to some example embodiments, the method further includes: transferring, by the timing controller, frame configuration signals via the high speed driving line or the low speed driving line; and providing, by the data driver, the data voltage corresponding to the image signals to the display panel according to the frame configuration signals additionally.

BRIEF DESCRIPTION OF THE DRAWINGS

The accompanying drawings are included to provide a further understanding of some aspects of some example embodiments of the present invention, and are incorporated in and constitute a part of this specification. The drawings illustrate some aspects of some example embodiments of the present invention and, together with the description, serve to explain some features of some example embodiments of the present invention. In the drawings.

DETAILED DESCRIPTION

Figure 1:
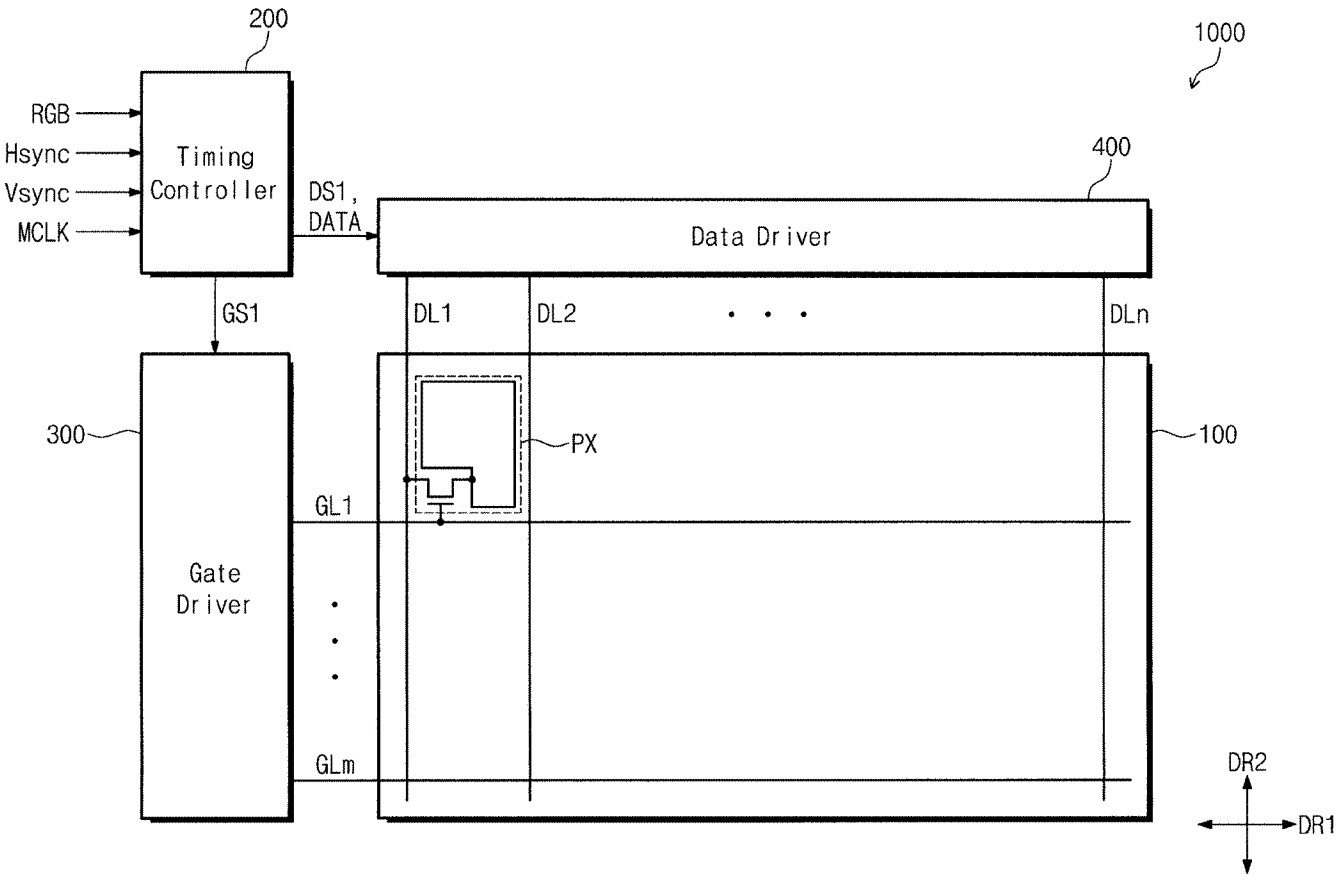
FIG. 1 is a schematic block diagram illustrating a display device according to some example embodiments of the present invention.

Aspects of example embodiments of the present invention may be variously modified without departing from the spirit and scope of the present invention as defined by the claims, and may include various modes. However, some example embodiments are illustrated in the drawings and are described in some detail below. However, it should be understood that example embodiments of the present invention are not limited to specific forms, but rather cover all modifications, equivalents or alternatives that fall within the spirit and scope of the present invention.

Figure 2:
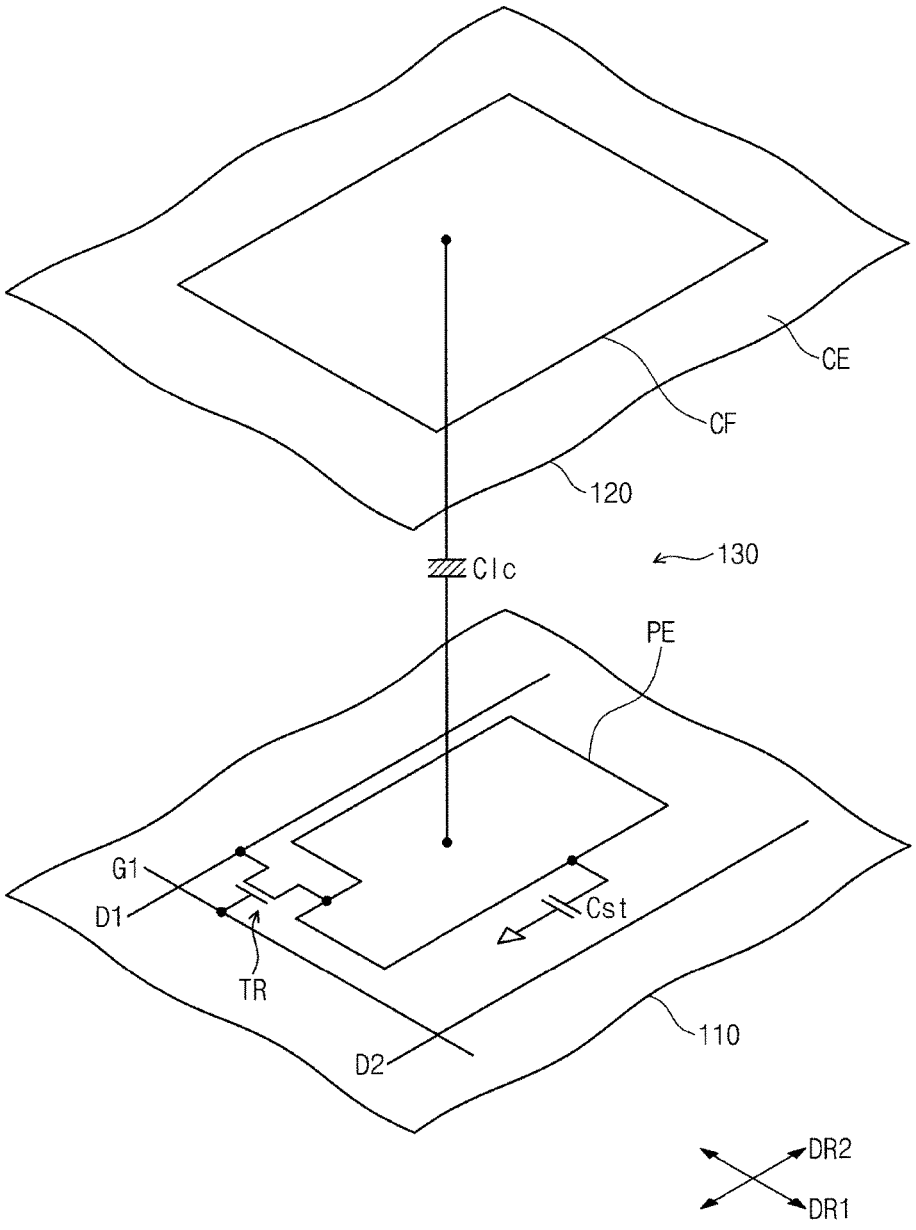
FIG. 2 is an equivalent circuit of a single pixel illustrated in FIG. 1.

FIG. 1 is a block diagram illustrating a display device according to some example embodiments of the present invention, and FIG. 2 is an equivalent circuit of a single pixel illustrated in FIG. 1.

As illustrated in FIG. 1, a display device 1000 according to some example embodiments of the present invention includes a display panel 100, a timing controller 200, a gate driver 300, and a data driver 400.

The display panel 100 may display an image. The display panel 100 may be various display panels such as an organic light-emitting display panel, a liquid crystal display panel, a plasma display panel, an electrophoretic display panel, an electrowetting display panel, etc. The display panel 100 is described in the context of a liquid crystal display panel below, but a liquid crystal display panel is one example embodiment, and embodiments of the present invention are not limited thereto.

The display panel 100 may include a lower substrate 110, an upper substrate 120 facing the lower substrate 110, and a liquid crystal layer 130 between the lower substrate 110 and the upper substrate 120.

The display panel 100 includes a plurality of gate lines GL1 to GLm extending in a first direction DR1 and a plurality of data lines DL1 to DLn extending in a second direction DR2 intersecting with the first direction DR1. The gate lines GL1 to GLm and the data lines DL1 to DLn define pixel regions, each of which is provided with a pixel PX for displaying an image. FIG. 1 illustrates, for example, the pixel PX connected to the first gate line GL1 and the first data line DL1, but a person having ordinary skill in the art would understand that the display panel 100 includes a plurality of pixels connected to the data lines DL1 to DLn and the gate lines GL1 to GLm, depending on the design of the display panel 100.

The pixel PX may include a thin-film transistor TR, a liquid crystal capacitor Clc, and a storage capacitor Cst. The thin-film transistor TR may be connected to one of the gate lines GL1 to GLm and one of the data lines DL1 to DLn. The liquid crystal capacitor Clc may be connected to the thin-film transistor TR. The storage capacitor Cst may be connected in parallel to the liquid crystal capacitor Clc. According to some example embodiments, the storage capacitor Cst may be omitted.

The thin-film transistor TR may be provided to the lower substrate 110. The thin-film transistor TR, which is a three-terminal element, may have a control terminal, one terminal, and the other terminal. The control terminal of the thin-film transistor TR may be connected to the first gate line GL1, the one terminal of the thin-film transistor TR may be connected to the first data line DL1, and the other terminal of the thin-film transistor TR may be connected to the liquid crystal capacitor Clc and the storage capacitor Cst.

The liquid crystal capacitor Clc includes, as two terminals, a pixel electrode PE provided to the lower substrate 110 and a common electrode CE provided to the upper substrate 120, and the liquid crystal layer 130 between the pixel electrode PE and the common electrode CE acts as a dielectric. The pixel electrode PE is connected to the thin-film transistor TR, and the common electrode CE is formed over the upper substrate 120 and receives a common voltage. Unlike the common electrode CE illustrated in FIG. 2, the common electrode CE may be provided to the lower substrate 110, and in this case, at least one of the two electrodes PE and CE may have a slit.

The storage capacitor Cst may be supplementary to the liquid crystal capacitor Clc, and may include the pixel electrode PE, a storage line, and an insulator between the pixel electrode PE and the storage line. The storage line may be provided to the lower substrate 110 so as to overlap a part of the pixel electrode PE. A fixed voltage such as a storage voltage is applied to the storage line.

The pixel PX may display one of primary colors. The primary colors may include red, green, blue, and white. However, example embodiments of the present invention are not limited thereto, and thus the primary colors may further include various colors such as yellow, cyan, magenta, etc.

The pixel PX may further include a color filter CF presenting one of the primary colors. FIG. 2 illustrates, for example, the color filter CF as being provided to the upper substrate 120, but example embodiments of the present invention are not limited thereto, and thus the color filter CF may be provided to the lower substrate 110.

The timing controller 200 receives an input image signal RGB and a control signal from an external graphic control unit. The control signal may include a vertical synchronization signal (hereinafter referred to as a "Vsync signal") for differentiating frames, a horizontal synchronization signal (hereinafter referred to as a "Hsync signal") for differentiating rows, and a main clock signal MCLK.

The timing controller 200 generates a gate control signal GS1 and a data control signal DS1. The timing controller 200 may output the gate control signal GS1 to the gate driver 300, and may output the data control signal DS1 to the data driver 400.

The gate control signal GS1 is used to drive the gate driver 300, and the data control signal DS1 is used to drive the data driver 400.

The gate driver 300 generates a gate signal on the basis of the gate control signal GS1, and outputs the gate signal to the gate lines GL1 to GLm. The gate control signal GS1 may include a scanning start signal for indicating a start of scanning, at least one clock signal for controlling an output period of a gate-on voltage, and an output enable signal for limiting a duration time of the gate-on voltage.

The data driver 400 generates a gradation voltage according to a modulated input image signal DATA on the basis of the data control signal DS1, and outputs the generated gradation voltage as a data voltage to the data lines DL1 to DLn. The data voltage may include a positive data voltage having a positive value with respect to a common voltage and a negative data voltage having a negative value with respect to the common voltage.

The data control signal DS1 may include a horizontal start signal STH for indicating a start of transmission of the modulated input image signal DATA to the data driver 400, a load signal for giving instructions to apply the data voltage to the data lines DL1 to DLn, and a polarity signal for reversing a polarity of the data voltage with respect to the common voltage. Each of the timing controller 200, the gate driver 300, and the data driver 400 may be directly mounted on the display panel 100 in a form of at least one integrated circuit chip, or may be mounted on a flexible printed circuit board so as to be attached to the display panel 100 in a form of a tape carrier package (TCP), or may be mounted on a separate printed circuit board.

According to some example embodiments, at least one of the gate driver 300 or the data driver 400 may be integrated with the display panel 100 together with the gate lines GL1 to GLm, the data lines DL1 to DLn, and the thin-film transistor TR. The timing controller 200, the gate driver 300, and the data driver 400 may be integrated as a single chip.

Figure 3:
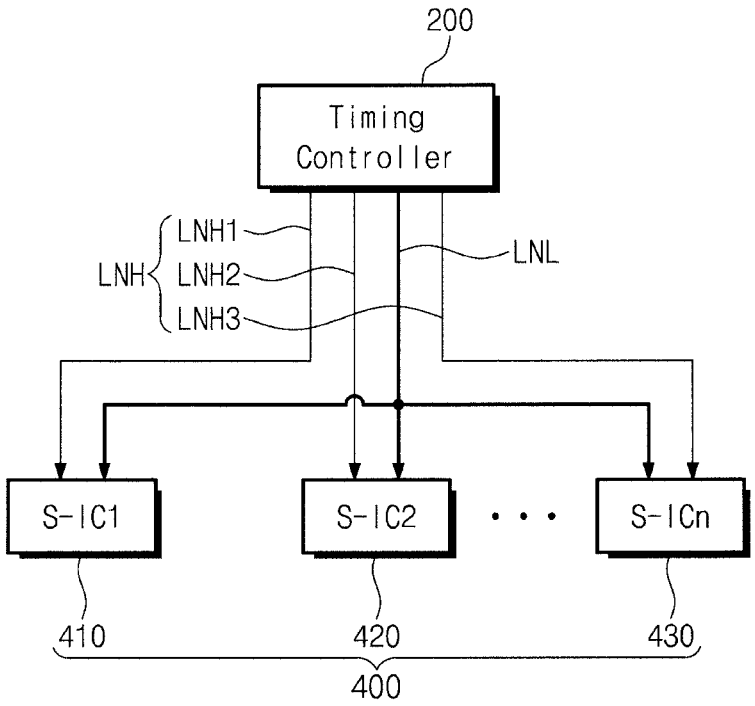
FIG. 3 is a block diagram illustrating the timing controller and the data driver of FIG. 1.

FIG. 3 is a block diagram illustrating the timing controller and the data driver of FIG. 1.

Referring to FIG. 3, the data driver 400 may include first to n-th data drivers 410, 420, and 430.

The display device may further include a high speed driving line LNH and a low speed driving line LNL for connecting the timing controller 200 and the data drivers 410 to 430.

The high speed driving line LNH and the low speed driving line LNL transfer data according to different interfaces. The high speed driving line LNH and the low speed driving line LNL may have a higher transfer efficiency than that of the low speed driving line LNL.

The high speed driving line LNH may include high speed driving lines LNH1 to LNH3, the number of which is the same as the data drivers 410 to 430. The high speed driving lines LNH1 to LNH3 respectively connect the timing controller 200 to the data drivers 410 to 430. According to some example embodiments of the present invention, the first high speed driving line LNH1 connects the timing controller 200 to the first data driver 410, the second high speed driving line LNH2 connects the timing controller 200 to the second data driver 420, and the third high speed driving line LNH3 connects the timing controller 200 to the n-th data driver 430. Therefore, the timing controller 200 individually transfers signals to the data drivers 410 to 430 via the high speed driving lines LNH1 to LNH3.

The low speed driving line LNL connects the timing controller 200 and the data drivers 410 to 430. Because the low speed driving line LNL is commonly connected to the data drivers 410 to 430, a signal transferred from the timing controller 200 via the low speed driving line LNL may be equally delivered to the data drivers 410 to 430.

Figure 4:
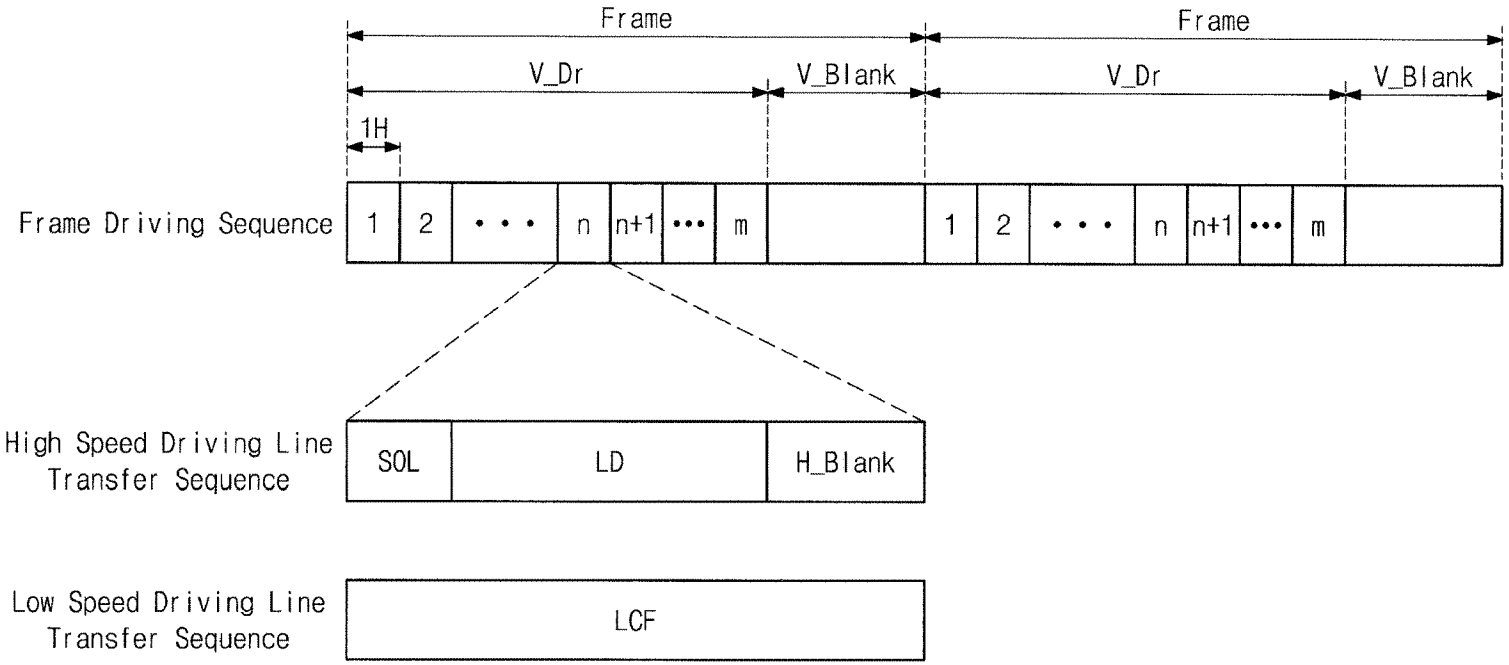
FIG. 4 is a diagram illustrating an operation sequence according to some example embodiments of the present invention.

FIG. 4 is a diagram illustrating an operation sequence according to some example embodiments of the present invention.

FIGS. 1, 3, and 4 illustrate a frame driving sequence showing data transferred during two frames, a high speed driving line transfer sequence showing data transferred via a high speed driving line during a horizontal driving period, and a low speed driving line transfer sequence showing data transferred via a low speed driving line during a horizontal driving period.

One frame may be divided into a vertical driving period V_Dr and a vertical blank period V_Blank. An image signal corresponding to one frame is output in a unit of line data during the vertical driving period V_Dr. FIG. 4 illustrates, for example, that m number of line data are output in order. The vertical blank period V_Blank represents an interval in which, after an image signal corresponding to one frame is output, an image signal is not applied until an image signal corresponding to a next frame is output.

Each line data is output during a horizontal driving period 1H. The high speed driving line transfer sequence is illustrated by magnifying the horizontal driving period 1H in which n-th line data LD is transferred. During the horizontal driving period 1H in which the n-th line data LD is transferred, the timing controller 200 sequentially outputs a line start signal SOL and the n-th line data LD via the high speed driving lines LNH1 to LNH3. Thereafter, a horizontal blank period H_Blank is maintained until a next horizontal driving period starts. The horizontal blank period H_Blank represents a period in which the line start signal SOL and the line data LD are not applied.

The data control signal DS1 may include a line configuration signal LCF and a frame configuration signal. The line configuration signal LCF may include configuration information of the data driver 400 required when outputting the line data LD as a data voltage. The frame configuration signal may include configuration information of the data driver 400 required when outputting an image signal corresponding to one frame as a data voltage. The timing controller 200 outputs the line configuration signal LCF whenever each line data is output, and outputs the frame configuration signal whenever an image signal corresponding to one frame is output.

The timing controller 200 outputs the line configuration signal LCF via the low speed driving lines LNL. In FIG. 4, the low speed driving line transfer sequence illustrates an (n+1)-th line configuration signal LCF applied during a period overlapping with a period in which n-th line data LD is applied. The n-th line configuration signal may include the configuration information of the data driver 400 required when outputting the n-th line data LD as a data voltage, and the (n+1)-th line configuration signal LCF may include the configuration information of the data driver 400 required when outputting the (n+1)-th line data LD as a data voltage. Since the (n+1)-th line configuration signal LCF is required to be output before the (n+1)-th line data is transferred, the (n+1)-th line configuration signal LCF is output during a period overlapping with a period in which the n-th line data LD is output, or is output prior to the period in which the n-th line data LD is output. In the present embodiment, the (n+1)-th line configuration signal LCF is illustrated, for example, as being output during a period overlapping with a period in which the n-th line data LD is output.

In a display device driving method according to some example embodiments of the present invention, the timing controller 200 transfers a line configuration signal via the low speed driving line LNL, so that a throughput of the high speed driving line LNH is improved. Furthermore, because a bandwidth of the high speed driving line LNH is improved, a target amount of data may be transferred even if a transfer rate is decreased, and thus power consumption is improved due to the improvement of the transfer rate.

Figure 5:
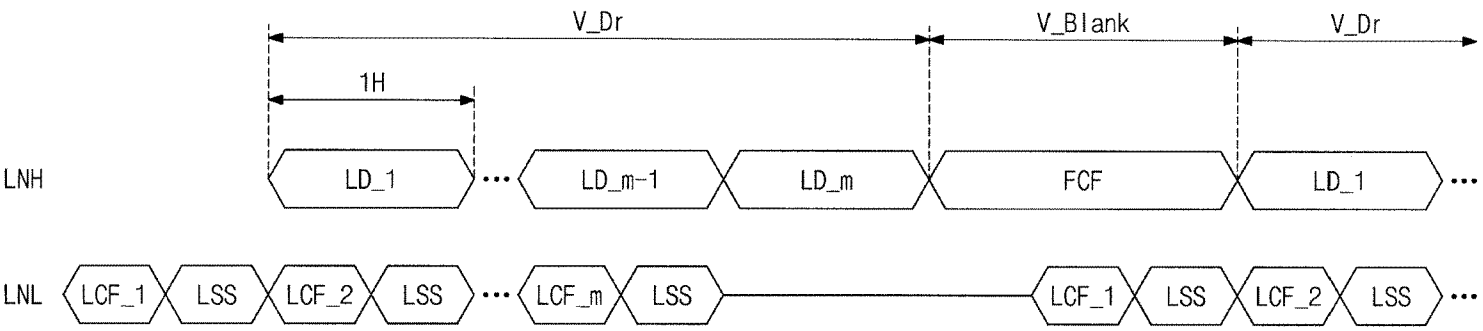
FIG. 5 is a diagram illustrating data applied to a high speed driving line and a low speed driving line during a frame in a display device according to some example embodiments of the present invention.

FIG. 5 is a diagram illustrating data applied to a high speed driving line and a low speed driving line during a frame in a display device according to some example embodiments of the present invention.

Referring to FIGS. 3 to 5, the timing controller 200 transfers, to the data driver 400, an image signal in a unit of line data via the high speed driving line LNH during the vertical driving period V_Dr. In FIG. 5, m number of line data LD_1 to LD_m constitute an image signal corresponding to one frame.

The timing controller 200 transfers a frame configuration signal FCF to the data driver 400 via the high speed driving line LNH during the vertical blank period V_Blank.

The timing controller 200 transfers line configuration signals LCF_1 to LCF_m to the data driver 400 via the low speed driving line LNL.

The n-th line configuration signal may include the configuration information of the data driver 400 required when outputting the n-th line data as a data voltage, and the (n+1)-th line configuration signal may include the configuration information of the data driver 400 required when outputting the (n+1)-th line data as a data voltage. Since the (n+1)-th line configuration signal is required to be output before the (n+1)-th line data is transferred, the (n+1)-th line configuration signal is output during a period overlapping with a period in which the n-th line data is output. In FIG. 5, the second line configuration signal LCF_2 may be output during a period overlapping with a horizontal driving period 1H in which the first line data LD_1 is output. Likewise, the mth line configuration signal LCF_m may be output during a period overlapping with a horizontal driving period in which the (m−1)-th line data LD_m−1 is output.

The data driver 400 transfers a link state signal LSS to the timing controller 200 via the low speed driving line LNL. The link state signal LSS is a feedback signal having information about a link state between the timing controller 200 and the data driver 400. For example, when a link between the timing controller 200 and the data driver 400 is normal, the link state signal LSS may have a high level, or when the link between the timing controller 200 and the data driver 400 is not normal, the link state signal LSS may have a low level.

The link state signal LSS may be transferred immediately after each of the line configuration signals LCF_1 to LCF+m is transferred to the data driver 400. In other words, the link state signal LSS may be transferred between periods in which consecutive two line configuration signals LCF_1 and LCF_2 are applied. The link state signal LSS may be transferred before next line data (e.g., mth line data LD_m) is applied after a line configuration signal (e.g., mth line configuration signal LCF_m), which is applied during a period overlapping with a period in which current line data (e.g., (m−1)th line data LD_m−1) is applied, is applied.

Figure 6:
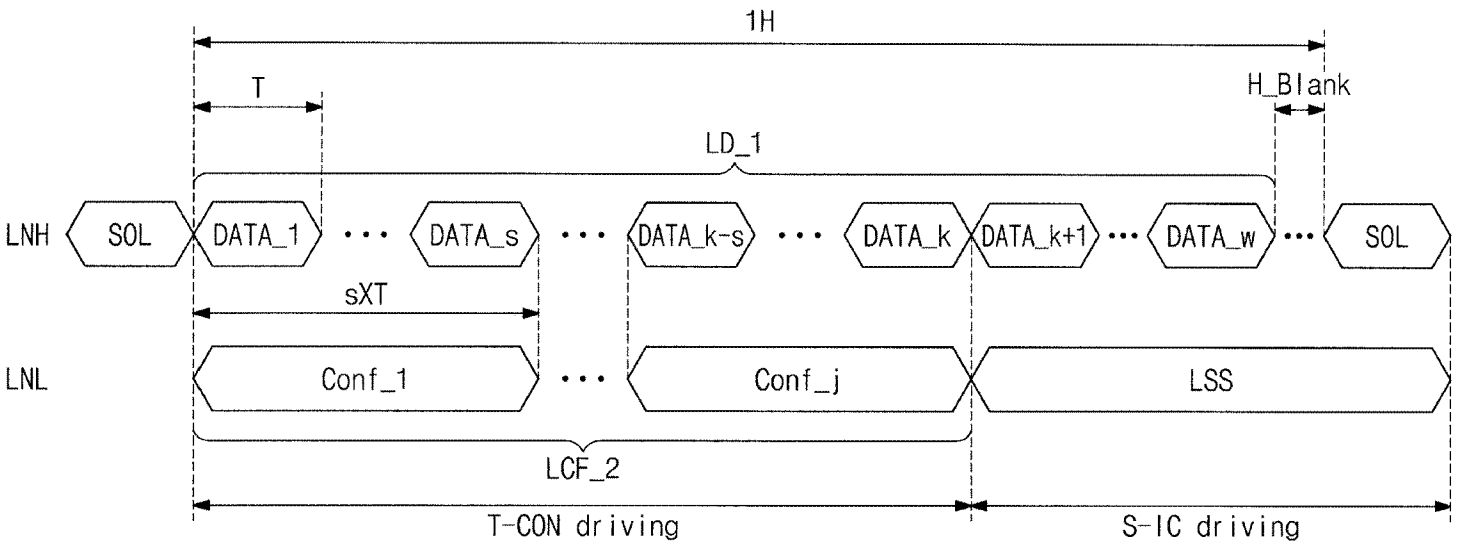
FIG. 6 is a diagram illustrating data applied to a high speed driving line and a low speed driving line during one horizontal driving period and a period adjacent thereto of FIG. 5.

FIG. 6 is a diagram illustrating data applied to a high speed driving line and a low speed driving line during one horizontal driving period and a period adjacent thereto of FIG. 5. FIG. 6 exemplarily illustrates the horizontal driving period 1H in which the first line data LD_1 is transferred and a period adjacent thereto.

Referring to FIG. 6, the line start signal SOL is output, and the first line data LD_1 is output. The line start signal SOL and the first line data LD_1 may be transferred in a unit of a line segment set by a communication protocol of the high speed driving line LNH. One line segment may be transferred during an allocated line segment period T. FIG. 6 exemplarily illustrates that the first line data LD_1 includes w number of line segments DATA_1 to DATA_w (where w is a natural number).

The second line configuration signal LCF_2 may be transferred in a unit of a line configuration segment set by a communication protocol of the low speed driving line LNL. FIG. 6 exemplarily illustrates that the second line configuration signal LCF_2 includes j number of line configuration segments Conf_1 to Conf_j (where j is a natural number).

One line configuration segment may be transferred in synchronization with s number of line segments (where s is a natural number smaller than w). In FIG. 6, the first line configuration segment Conf_1 may be transferred in synchronization with first to n-th line segments DATA_1 to DATA_n. The first line configuration segment Conf_1 may be transferred during an allocated line configuration segment period defined as sxT.

Referring to FIGS. 4 to 6, the timing controller 200 transfers each of the line configuration segments Conf_1 to Conf_j of the line configuration signal LCF in synchronization with n times each of the line segments DATA_1 to DATA_w of the line data LD, and thus an additional clock signal for controlling a timing of the line configuration signal LCF is not required.

Therefore, in a display device according to some example embodiments of the present invention, the transfer efficiency of the high speed driving line LNH may be improved by improving the bandwidth of the high speed driving line LNH.

Figure 7:
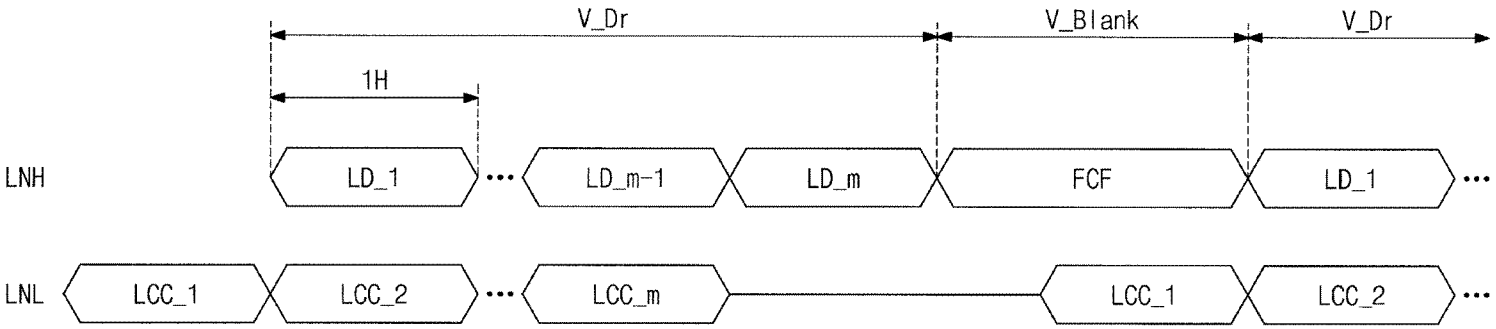
FIG. 7 is a diagram illustrating data applied to a high speed driving line and a low speed driving line during a frame in a display device according to some example embodiments of the present invention.
Figure 8:
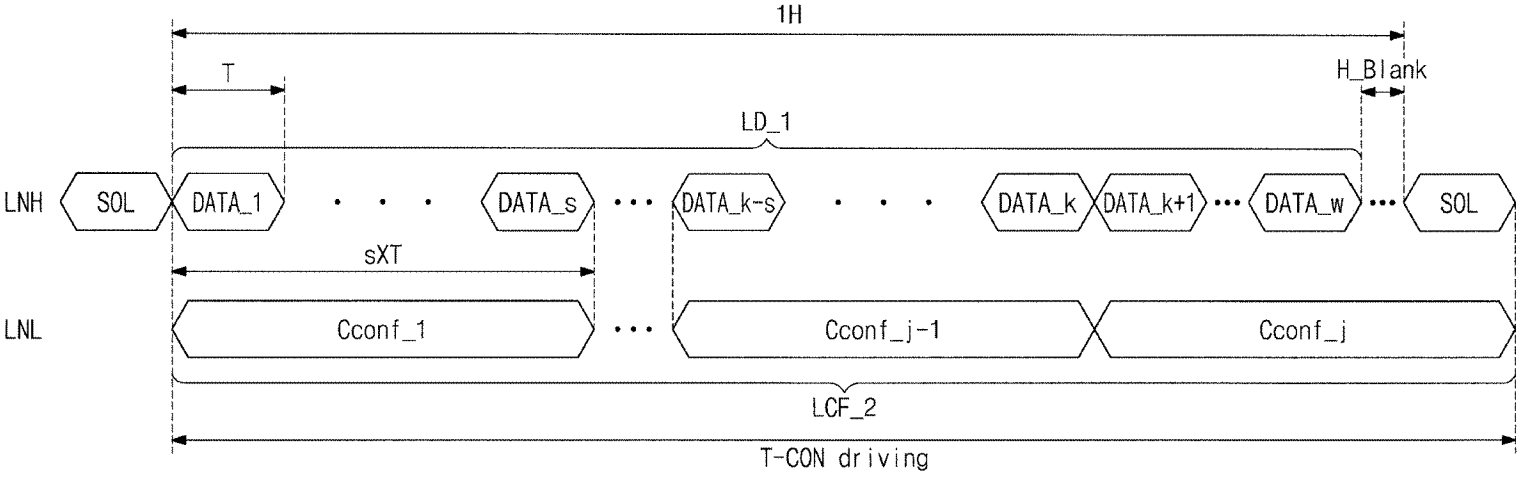
FIG. 8 is a diagram illustrating data applied to a high speed driving line and a low speed driving line during one horizontal driving period and a period adjacent thereto of FIG. 7.

FIG. 7 is a diagram illustrating data applied to a high speed driving line and a low speed driving line during a frame in a display device according to some example embodiments of the present invention, and FIG. 8 is a diagram illustrating data applied to a high speed driving line and a low speed driving line during one horizontal driving period and a period adjacent thereto of FIG. 7. FIG. 8 illustrates, for example, the horizontal driving period 1H in which the first line data LD_1 is transferred and a period adjacent thereto.

The following description of the display device driving method provided with reference to FIGS. 7 and 8 is focused on differences from the display device driving method described above with reference to FIGS. 5 and 6, and some repetitive descriptions are not provided below.

Referring to FIGS. 3, 7, and 8, the timing controller 200 codes line configuration signals through the low speed driving line LNL, and generates coding line configuration signals LCC_1 to LCC_m. The timing controller 200 transfers the coding line configuration signals LCC_1 to LCC_m to the data driver 400. The timing controller 200 senses information about the link state with the data driver 400 through the coding line configuration signals LCC_1 to LCC_m.

The data driver 400 does not transfer an additional link state signal to the timing controller 200. Therefore, the coding line configuration signals LCC_1 to LCC_m may be continuously output through the low speed driving line LNL. One line configuration segment included in each of the coding line configuration signals LCC_1 to LCC_m may be transferred in synchronization with s number of line segments.

When an error occurs on a link with the timing controller 200, the data driver 400 transfers a signal having a first level (e.g., low level) through the low speed driving line LNL regardless of a timing. For example, when the link error occurs, the data driver 400 may ground a terminal connected to the low speed driving line LNL (in the case of outputting a low level), or may connect the terminal to a pull-up circuit (in the case of outputting a high level).

While transferring the coding line configuration signals LCC_1 to LCC_m through the low speed driving line LNL, the timing controller 200 may determine that the link error has occurred if a first level (e.g., low level) is sensed during a period in which the coding line configuration signals LCC_1 to LCC_m have a second level (e.g., high level). Therefore, the coding line configuration signal LCC is required to have a second level (e.g., high level) regardless of a level of the line configuration signal LCF. The cording line configuration signals LCC may be coded in various manners in which the coding line configuration signals LCC has the same information as the line configuration signal LCF and has a second level (e.g., high level).

Figure 9:
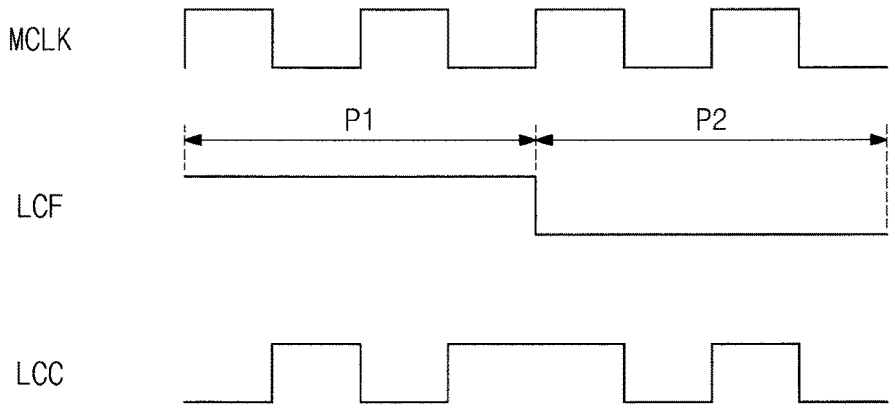
FIG. 9 is a timing diagram illustrating a main clock signal, a line configuration signal, and a coding line configuration signal according to some example embodiments of the present invention.

FIG. 9 is a timing diagram illustrating the main clock signal MCLK, the line configuration signal LCF, and the coding line configuration signal LCC according to an embodiment of the inventive concept. One of various methods for coding the coding line configuration signal LCC is exemplarily described below with reference to FIG. 9.

The timing controller 200 may generate the coding line configuration signal LCC by performing an XOR operation on the main clock signal MCLK and the line configuration signal LCF. During a period P1 in which the line configuration signal LCF has a high level, the coding line configuration signal LCC may have both a high level and a low level, and during a period P2 in which the line configuration signal LCF has a low level, the coding line configuration signal LCC may have both a high level and a low level.

Therefore, the coding line configuration signal LCC may have both a high level and a low level regardless of the line configuration signal LCF.

When the data driver 400 transfers a signal having a low level to the low speed driving line LNL at the time of occurrence of the link error, the timing controller 200 may sense the link state by detecting an input waveform of a period in which the coding line configuration signal LCC has a high level.

According to the display device driving method described above with reference to FIGS. 7 to 9, the timing controller 200 may sense the link state on the basis of the coding line configuration signal LCC even though the data driver 400 does not transfer an additional link state signal to the timing controller 200.

Figure 10:
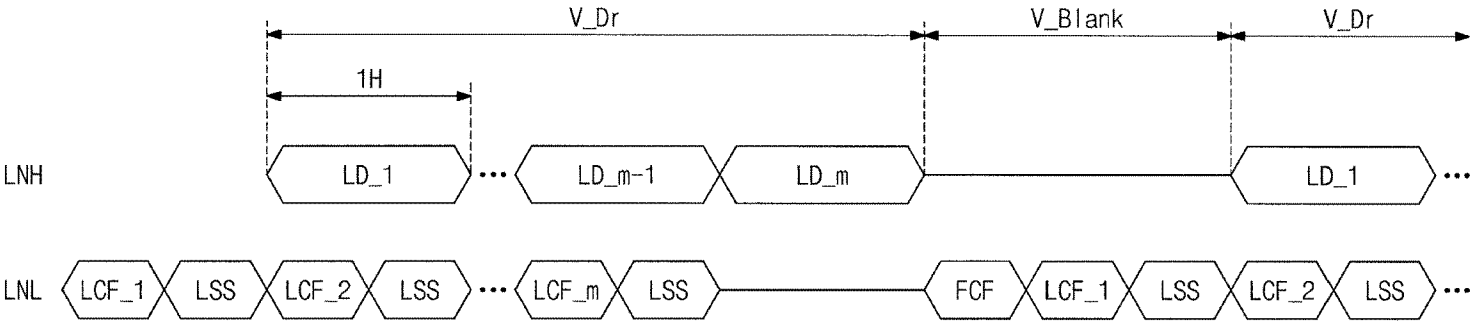
FIG. 10 is a diagram illustrating data applied to a high speed driving line and a low speed driving line during a frame in a display device according to some example embodiments of the present invention.
Figure 11:
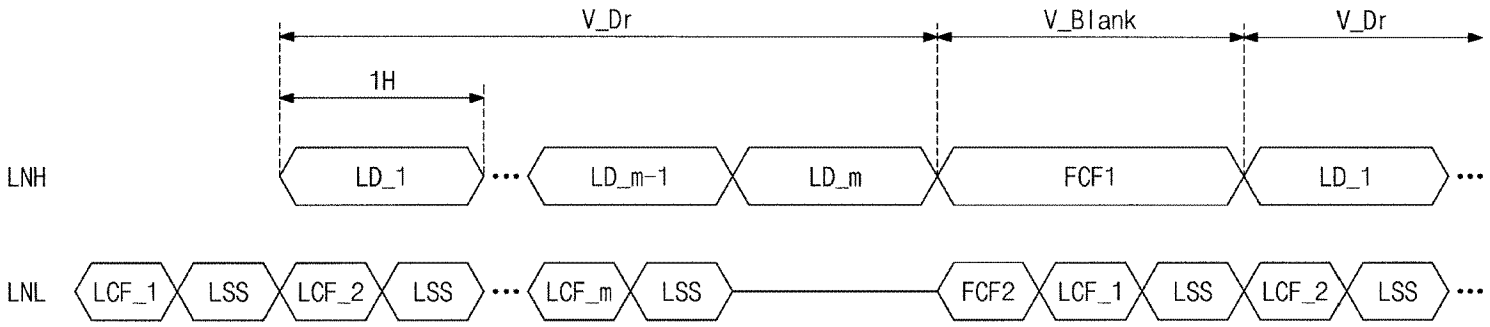
FIG. 11 is a diagram illustrating data applied to a high speed driving line and a low speed driving line during a frame in a display device according to some example embodiments of the present invention.

FIG. 10 is a diagram illustrating data applied to a high speed driving line and a low speed driving line during a frame in a display device according to some example embodiments of the present invention, and FIG. 11 is a diagram illustrating data applied to a high speed driving line and a low speed driving line during a frame in a display device according to some example embodiments of the present invention.

The following description of the display device driving method provided with reference to FIGS. 10 and 11 is focused on differences from the display device driving method described above with reference to FIG. 5, and thus some repetitive descriptions are not provided below.

Referring to FIG. 10, the timing controller 200 transfers the frame configuration signal FCF to the data driver 400 through the low speed driving line LNL. The frame configuration signal FCF may be transferred during a period overlapping with the vertical blank period V_Blank. The frame configuration signal FCF may be transferred within the vertical blank period V_Blank as illustrated in FIG. 10, or may be transferred during a period overlapping with the vertical blank period V_Blank and a period in which the mth line data LD_m is output.

Referring to FIG. 11, the frame configuration signal may include a first frame configuration signal FCF1 and a second frame configuration signal FCF2. The first frame configuration signal FCF1 may include a part of the configuration information of the data driver 400 required when outputting an image signal corresponding to one frame as a data voltage, and the second frame configuration signal FCF2 may include the remaining part of the configuration information.

The timing controller 200 transfers the first frame configuration signal FCF1 to the data driver 400 via the high speed driving line LNH during the vertical blank period V_Blank. The timing controller 200 transfers the second frame configuration signal FCF2 to the data driver 400 via the low speed driving line LNL. The second frame configuration signal FCF2 may be transferred during a period overlapping with the vertical blank period V_Blank. The second frame configuration signal FCF2 may be transferred within the vertical blank period V_Blank as illustrated in FIG. 11, or may be transferred during a period overlapping with the vertical blank period V_Blank and a period in which the mth line data LD_m is output.

Figure 12:
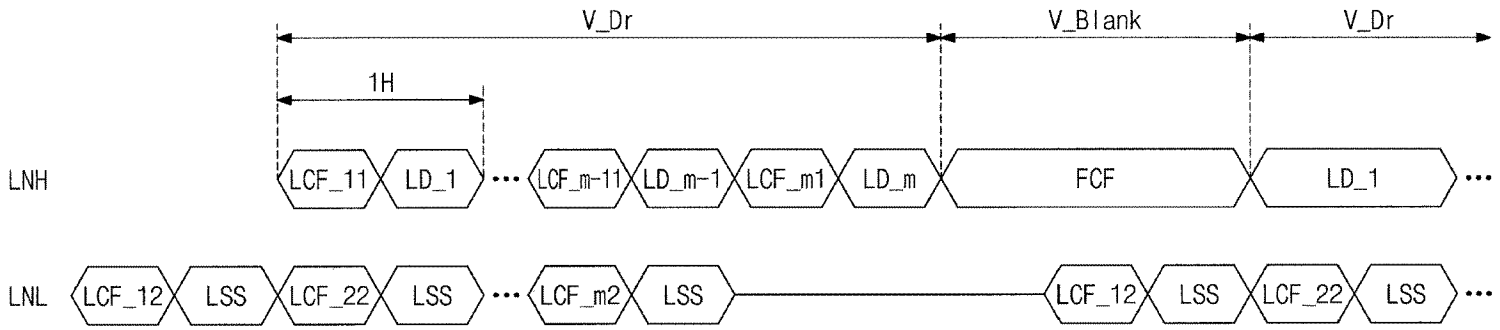
FIG. 12 is a diagram illustrating data applied to a high speed driving line and a low speed driving line during a frame in a display device according to some example embodiments of the present invention.

FIG. 12 is a diagram illustrating data applied to a high speed driving line and a low speed driving line during a frame in a display device according to some example embodiments of the present invention.

The following description of the display device driving method provided with reference to FIG. 12 is focused on differences from the display device driving method described above with reference to FIG. 5, and thus some repetitive descriptions are not provided below.

Referring to FIG. 12, the line configuration signal may include high speed line configuration signals LCF_11 to LCF_m1 and low speed line configuration signals LCF_12 to LCF_m2. One of the high speed line configuration signals LCF_11 to LCF_m1 may include a part of the configuration information of the data driver 400 required when outputting one piece of line data as a data voltage, and one of the low speed line configuration signals LCF_12 to LCF_m2 may include the remaining part of the configuration information. For example, the first high speed line configuration signal LCF_11 and the first low speed line configuration signal LCF_12 may include the configuration information of the data driver 400 required when outputting the first line data LD_1.

The timing controller 200 outputs the high speed line configuration signals LCF_11 to LCF_m1 via the high speed driving line LNH. Within one horizontal driving period 1H, the timing controller 200 transfers the first high speed line configuration signal LCF_11 prior to the first line data LD_1.

The timing controller 200 transfers the low speed line configuration signals LCF_12 to LCF_m2 via the low speed driving line LNL. The first low speed line configuration signal LCF_12 is transferred before the horizontal driving period 1H in which the first line data LD_1 is output. The second low speed line configuration signal LCF_22 is output during a period overlapping with a period in which the first line data LD_1 is output.

According to the display device driving method described above with reference to FIG. 12, the timing controller 200 transfers a portion of the line configuration signals via the high speed driving line LNH and transfers the remaining portion of the line configuration signals via the low speed driving line LNL, so that the transfer efficiency of the high speed driving line LNH may be improved.

Figure 13:
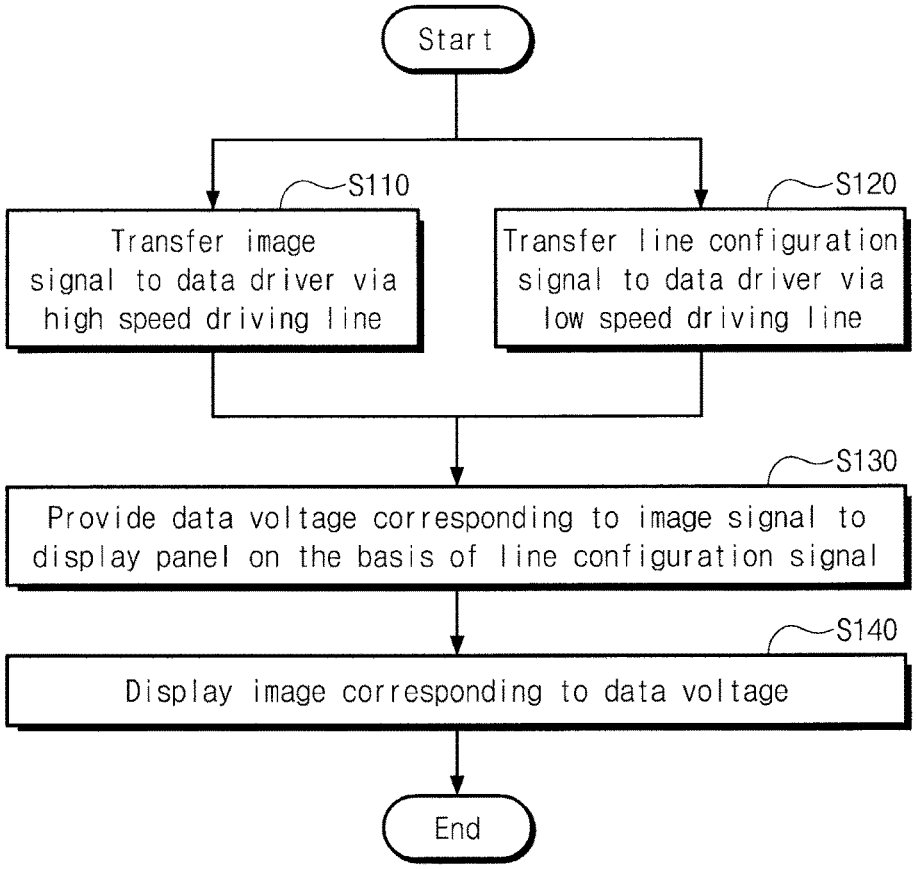
FIGS. 13 to 18 are flowcharts illustrating methods for driving a display device according to some example embodiments of the present invention.

FIG. 13 is a flowchart illustrating a method for driving a display device according to some example embodiments of the present invention.

Referring to FIGS. 1, 4 to 6, and 13, the method for driving a display device according to an embodiment of the inventive concept includes: transferring, by the timing controller 200, the image signal RGB to the data driver 400 via the high speed driving line LNH (S110); transferring, by the timing controller 200, the line configuration signal LCF to the data driver 400 via the low speed driving line LNL (S120); providing, by the data driver 400, a data voltage corresponding to the image signal RGB to the display panel 100 on the basis of the line configuration signal LCF (S130); and displaying, by the display panel 100, an image corresponding to the data voltage (S140).

Operations S110, S120, S130, and S140 have been described with reference to FIGS. 1 to 6, and are thus not described in detail below.

Figure 14:
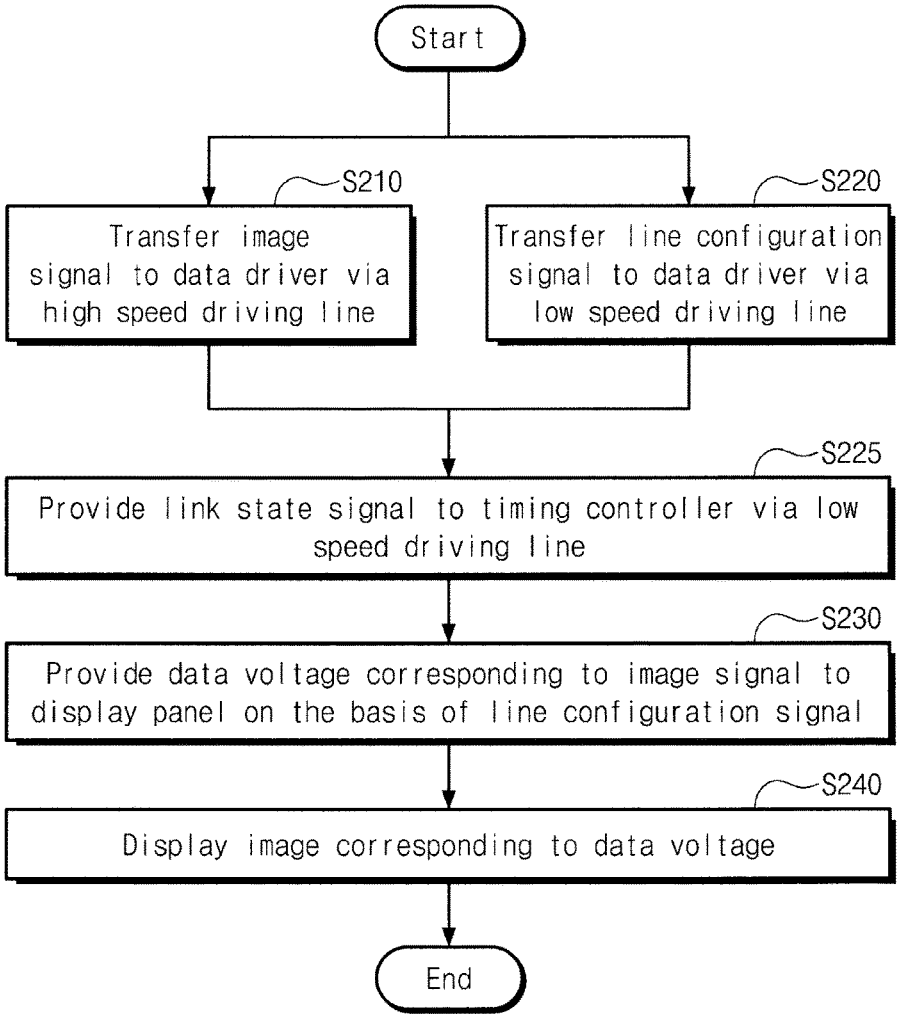

FIG. 14 is a flowchart illustrating a method for driving a display device according to some example embodiments of the present invention.

Referring to FIGS. 3, 4 to 6, and 14, the method for driving a display device according to another embodiment of the inventive concept includes: transferring, by the timing controller 200, the image signal RGB to the data driver 400 via the high speed driving line LNH (S210); transferring, by the timing controller 200, the line configuration signal LCF to the data driver 400 via the low speed driving line LNL (S220); providing the link state signal LSS to the timing controller 200 via the low speed driving line LNL (S225);

providing, by the data driver 400, a data voltage corresponding to the image signal RGB to the display panel 100 on the basis of the line configuration signal LCF (S230); and displaying, by the display panel 100, an image corresponding to the data voltage (S240).

The display device driving method of FIG. 14 is different from the display device driving method of FIG. 13 with respect to operation S225. Operation S225 has been described with reference to FIGS. 5 and 6, and is thus not described in detail below.

Figure 15:
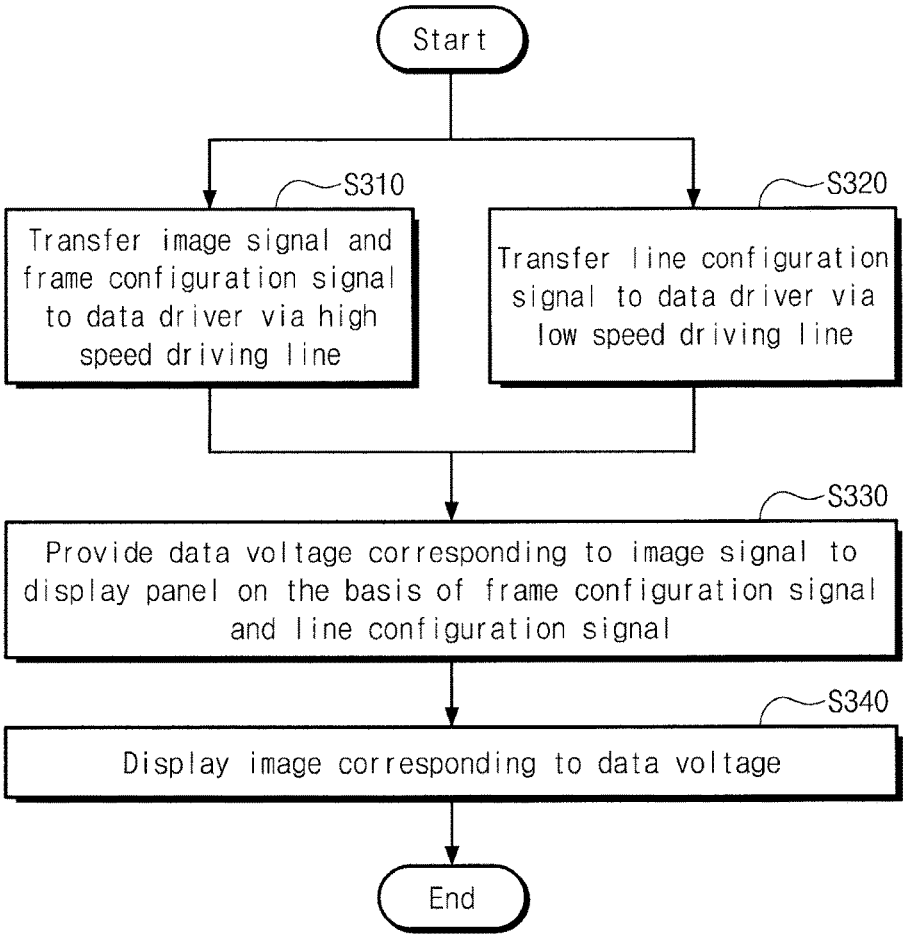

FIG. 15 is a flowchart illustrating a method for driving a display device according to some example embodiments of the present invention.

Referring to FIGS. 3, 4 to 6, and 15, a method for driving a display device according to some example embodiments of the present invention may include: transferring, by the timing controller 200, the image signal RGB and the frame configuration signal FCF to the data driver 400 via the high speed driving line LNH (S310); transferring, by the timing controller 200, the line configuration signal LCF to the data driver 400 via the low speed driving line LNL (S320); providing, by the data driver 400, a data voltage corresponding to the image signal RGB to the display panel 100 on the basis of the frame configuration signal FCF and the line configuration signal LCF (S330); and displaying, by the display panel 100, an image corresponding to the data voltage (S340).

The display device driving method of FIG. 15 is different from the display device driving method of FIG. 13 with respect to operations S310 and S330. Operations S310 and S330 have been described above with reference to FIG. 5, and are thus not described in detail below.

Figure 16:
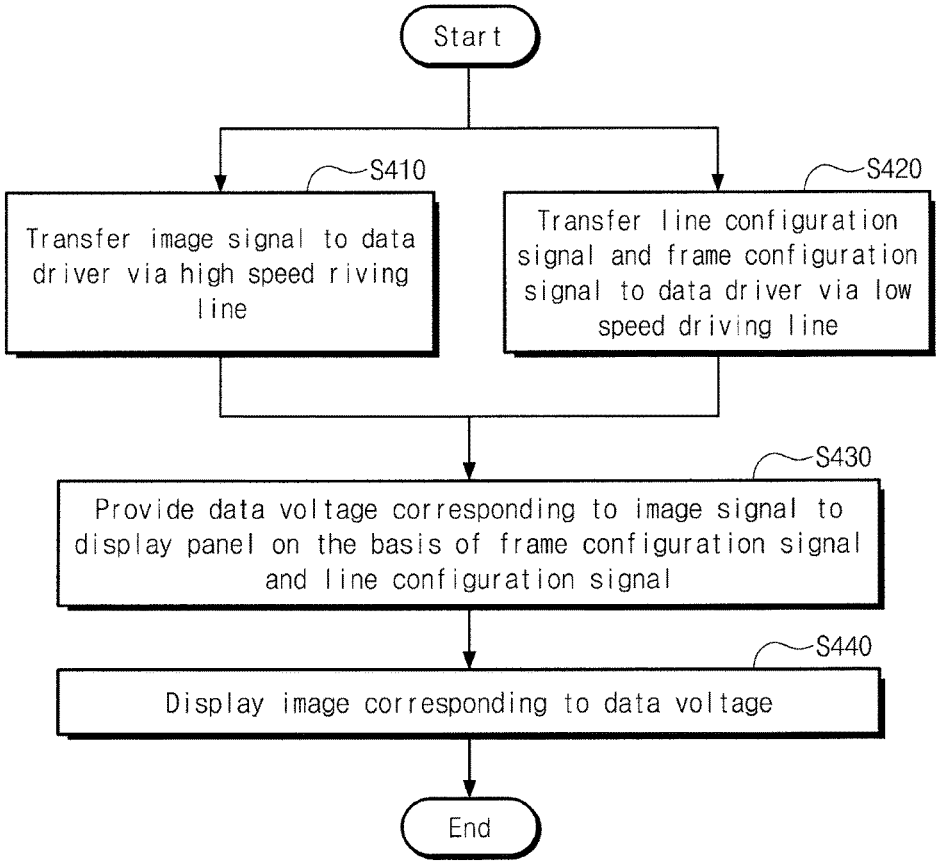

FIG. 16 is a flowchart illustrating a method for driving a display device according to some example embodiments of the present invention.

Referring to FIGS. 3, 4, 10, and 16, a method for driving a display device according to some example embodiments of the present invention may include: transferring, by the timing controller 200, the image signal RGB to the data driver 400 via the high speed driving line LNH (S410); transferring, by the timing controller 200, the frame configuration signal FCF and the line configuration signal LCF to the data driver 400 via the low speed driving line LNL (S420); providing, by the data driver 400, a data voltage corresponding to the image signal RGB to the display panel 100 on the basis of the frame configuration signal FCF and the line configuration signal LCF (S430); and displaying, by the display panel 100, an image corresponding to the data voltage (S440).

The display device driving method of FIG. 16 is different from the display device driving method of FIG. 13 with respect to operations S420 and S430. Operations S420 and S430 have been described above with reference to FIG. 10, and are thus not described in detail below.

Figure 17:
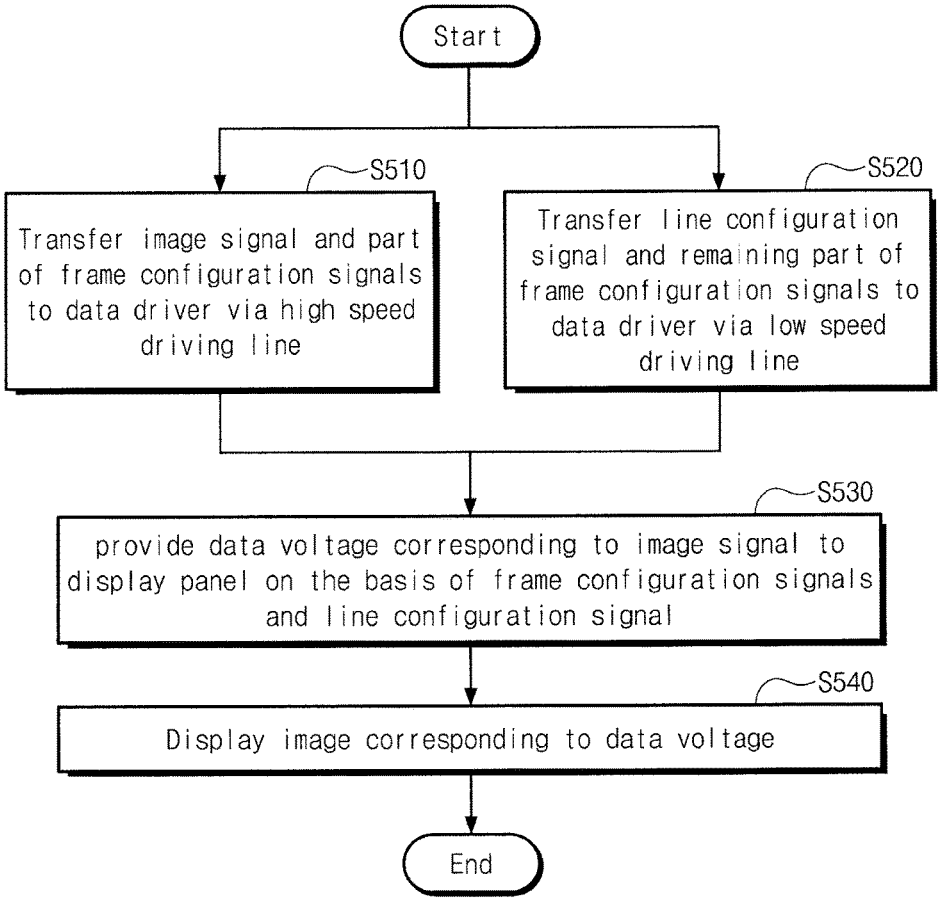

FIG. 17 is a flowchart illustrating a method for driving a display device according to some example embodiments of the present invention.

Referring to FIGS. 3, 4, 11, and 17, a method for driving a display device according to some example embodiments of the present invention may include: transferring, by the timing controller 200, the image signal RGB and a part of the frame configuration signal FCF to the data driver 400 via the high speed driving line LNH (S510); transferring, by the timing controller 200, the line configuration signal LCF and the remaining part of the frame configuration signal FCF to the data driver 400 via the low speed driving line LNL (S520); providing, by the data driver 400, a data voltage corresponding to the image signal RGB to the display panel 100 on the basis of the frame configuration signal FCF and the line configuration signal LCF (S530); and displaying, by the display panel 100, an image corresponding to the data voltage (S540).

The display device driving method of FIG. 17 is different from the display device driving method of FIG. 13 with respect to operations S510, S520, and S530. Operations S510, S520, and S530 have been described above with reference to FIG. 11, and are thus not described in detail below.

Figure 18:
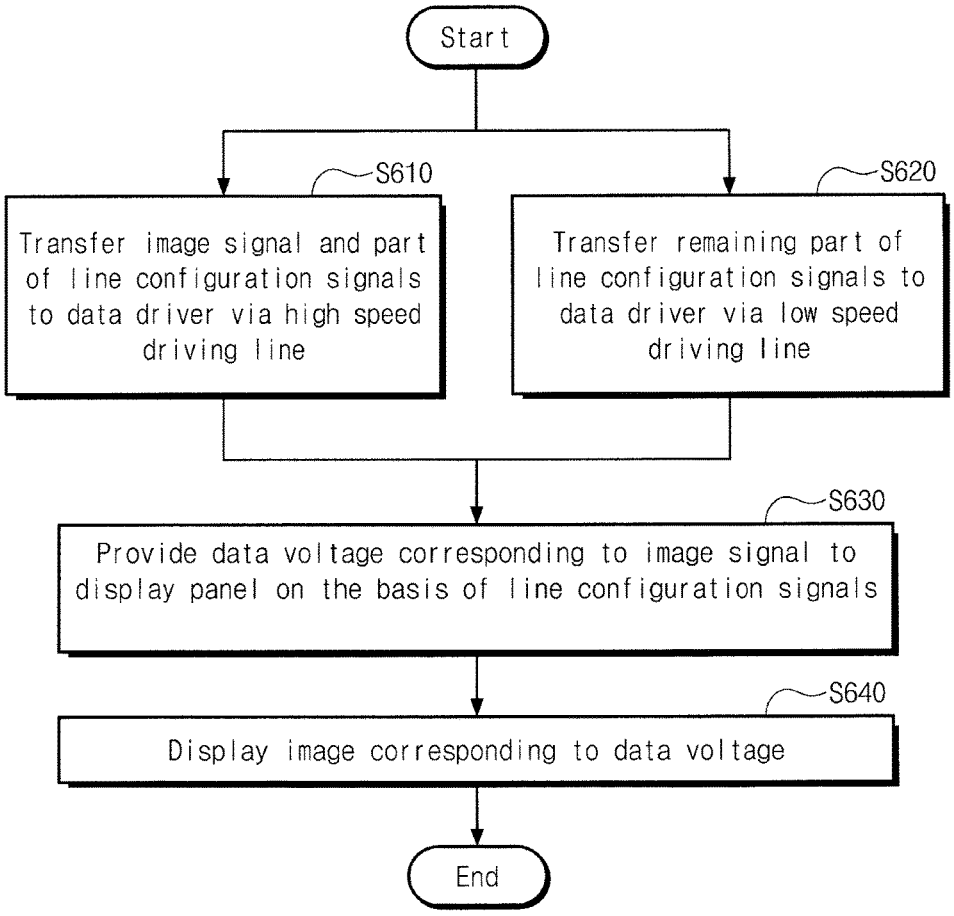

FIG. 18 is a flowchart illustrating a method for driving a display device according to some example embodiments of the present invention.

Referring to FIGS. 3, 4, 12, and 18, the method for driving a display device according to some example embodiments of the present invention may include: transferring, by the timing controller 200, the image signal RGB and a part of the line configuration signal LCF to the data driver 400 via the high speed driving line LNH (S610); transferring, by the timing controller 200, the remaining part of the line configuration signal LCF to the data driver 400 via the low speed driving line LNL (S620); providing, by the data driver 400, a data voltage corresponding to the image signal RGB to the display panel 100 on the basis of the line configuration signal LCF (S630); and displaying, by the display panel 100, an image corresponding to the data voltage (S640).

The display device driving method of FIG. 18 is different from the display device driving method of FIG. 13 with respect to operations S610 and S620. Operations S610 and S620 have been described above with reference to FIG. 12, and are thus not described in detail below.

According to a display device and a driving method thereof according to some example embodiments of the present invention, the throughput of a high speed driving line is improved since a timing controller transfers a line configuration signal via a low speed driving line. Furthermore, since the bandwidth of the high speed driving line is improved, a target amount of data may be transferred even if the transfer rate is decreased, and thus power consumption is improved due to the improvement of the transfer rate.

Although some example embodiments of the present invention have been described, it is understood that the present invention should not be limited to these example embodiments but various changes and modifications can be made by one ordinary skilled in the art within the spirit and scope of the present invention as defined by the appended claims, and their equivalents.

What is claimed is:

1. A display device comprising:

a display panel configured to display an image;

a timing controller configured to output line configuration signals, frame configuration signals, and image signals;

a plurality of data drivers each of which is configured to receive the line configuration signals, the frame configuration signals, and the image signals and provide a data voltage corresponding to the image signals to the display panel according to the line configuration signals and the frame configuration signals;

a high speed driving line configured to connect the timing controller and one of the data drivers and transfer the image signals from the timing controller to the one of the data drivers; and a low speed driving line configured to connect the timing controller and the data drivers and transfer the line configuration signals from the timing controller to the data drivers, wherein an (n+1)-th line configuration signal among the line configuration signals is output during a period overlapping with a period in which n-th line data among the line data is output, where n is a natural number.

2. The display device of claim 1, wherein the timing controller is configured to output the image signals in a unit of line data.

3. The display device of claim 1, wherein the data driver is configured to transfer a link state signal to the timing controller via the low speed driving line between periods in which two of the line configuration signals are applied.

4. The display device of claim 1, wherein the timing controller is configured to output the image signals in a unit of line data, wherein the line data is transferred in a unit of a line segment, wherein the line configuration signals are transferred in a unit of a line configuration segment, wherein one line configuration segment is transferred in synchronization with a plurality of the line segments.

5. The display device of claim 1, wherein the timing controller is configured to transfer an image signal corresponding to one frame among the image signals during a vertical synchronization period, and then transfer the frame configuration signals via the high speed driving line during a vertical blank period.

6. The display device of claim 1, wherein the timing controller is configured to transfer the frame configuration signals via the low speed driving line.

7. The display device of claim 1, wherein the frame configuration signals comprise a first frame configuration signal and a second frame configuration signal, wherein the first frame configuration signal comprises a part of configuration information of the data driver required when outputting the image signal corresponding to one frame as a data voltage, and the second frame configuration signal comprises a remaining part of the configuration information, wherein the timing controller transfers the first frame configuration signal via the high speed driving line, and transfers the second frame configuration signal via the low speed driving line.

8. The display device of claim 1, wherein the high speed driving line and the low speed driving line have different interfaces, wherein the high speed driving line has a higher transfer efficiency than that of the low speed driving line.

9. A display device comprising:

a display panel configured to display an image;

a timing controller configured to generate coding line configuration signals having a high level or a low level by coding received line configuration signals, and output the coding line configuration signals, frame configuration signals, and image signals;

data drivers each of which is configured to receive the coding line configuration signals, the frame configuration signals, and the image signals and provide a data voltage corresponding to the image signals to the display panel according to the coding line configuration signals and the frame configuration signals;

a high speed driving line configured to connect the timing controller and one of the data drivers and transfer the image signals from the timing controller to the one of the data drivers; and a low speed driving line configured to connect the timing controller and the data drivers and transfer the coding line configuration signals from the timing controller to the data drivers, wherein an (n+1)-th line configuration signal among the line configuration signals is output during a period overlapping with a period in which n-th line data among the line data is output, where n is a natural number.

10. The display device of claim 9, wherein the timing controller is configured to sense information about a link state with the data driver according to the line configuration signals.

11. A method for driving a display device, the method comprising:

transferring, by a timing controller, image signals to a data driver via a high speed driving line;

transferring, by the timing controller, line configuration signals to the data driver via a low speed driving line;

providing, by the data driver, a data voltage corresponding to the image signals to a display panel according to the line configuration signals;

outputting an (n+1)-th line configuration signal among the line configuration signals during a period overlapping with a period in which n-th line data among the line data is output, where n is a natural number; and displaying, by the display panel, an image corresponding to the data voltage.

12. The method of claim 11, further comprising:

providing, by the data driver, a link state signal to the timing controller via the low speed driving line.

13. The method of claim 11, further comprising:

transferring, by the timing controller, frame configuration signals via the high speed driving line; and providing, by the data driver, the data voltage corresponding to the image signals to the display panel according to the frame configuration signals additionally.

14. The method of claim 11, further comprising:

transferring, by the timing controller, frame configuration signals via the low speed driving line; and providing, by the data driver, the data voltage corresponding to the image signals to the display panel according to the frame configuration signals additionally.

15. The method of claim 11, further comprising:

transferring, by the timing controller, a part of frame configuration signals via the high speed driving line;

transferring, by the timing controller, a remaining part of the frame configuration signals via the low speed driving line; and providing, by the data driver, the data voltage corresponding to the image signals to the display panel according to the frame configuration signals additionally.

16. The method of claim 11, wherein transferring the image signals to the data driver via the high speed driving line comprises transferring the image signals in a unit of line data.

17. The method of claim 16, wherein the line data is transferred in a unit of a line segment, wherein the line configuration signals are transferred in a unit of a line configuration segment, wherein one line configuration segment is transferred in synchronization with a plurality of the line segments.

18. A method for driving a display device, the method comprising:

transferring, by a timing controller, image signals and a part of line configuration signals to a data driver via a high speed driving line;

transferring, by the timing controller, a remaining part of the line configuration signals to the data driver via a low speed driving line;

providing, by the data driver, a data voltage corresponding to the image signals to a display panel according to the line configuration signals;

outputting an (n+1)-th line configuration signal among the line configuration signals during a period overlapping with a period in which n-th line data among the line data is output, where n is a natural number; and displaying, by the display panel, an image corresponding to the data voltage.

19. The method of claim 18, further comprising:

providing, by the data driver, a link state signal to the timing controller via the low speed driving line.

20. The method of claim 18, further comprising:

transferring, by the timing controller, frame configuration signals via the high speed driving line or the low speed driving line; and providing, by the data driver, the data voltage corresponding to the image signals to the display panel according to the frame configuration signals additionally.

* * * * *